US010242689B2

(12) United States Patent
Chatlani

(10) Patent No.: US 10,242,689 B2
(45) Date of Patent: Mar. 26, 2019

(54) POSITION-ROBUST MULTIPLE MICROPHONE NOISE ESTIMATION TECHNIQUES

(71) Applicant: Intel IP Corporation, Santa Clara, CA (US)

(72) Inventor: Navin Chatlani, Allentown, PA (US)

(73) Assignee: INTEL IP CORPORATION, Santa Clara, CA (US)

( * ) Notice: Subject to any disclaimer, the term of this patent is extended or adjusted under 35 U.S.C. 154(b) by 68 days.

(21) Appl. No.: 14/857,087

(22) Filed: Sep. 17, 2015

(65) Prior Publication Data

US 2017/0084288 A1 Mar. 23, 2017

(51) Int. Cl.

| | |
|---|---|
| ***G10L 21/0216*** | (2013.01) |
| ***H04R 3/00*** | (2006.01) |
| *G10L 21/0232* | (2013.01) |
| *G10L 21/0264* | (2013.01) |
| *H04R 25/00* | (2006.01) |
| *G10L 25/84* | (2013.01) |

(52) U.S. Cl.

CPC ..... *G10L 21/0216* (2013.01); *H04R 3/005* (2013.01); *G10L 21/0232* (2013.01); *G10L 21/0264* (2013.01); *G10L 25/84* (2013.01); *G10L 2021/02165* (2013.01); *H04R 25/407* (2013.01); *H04R 2410/05* (2013.01); *H04R 2499/11* (2013.01); *H04R 2499/15* (2013.01)

(58) Field of Classification Search

None

See application file for complete search history.

(56) References Cited

U.S. PATENT DOCUMENTS 7,245,726 B2 7/2007 Du et al.
8,660,281 B2 * 2/2014 Bouchard ..... G10L 21/0208 381/23.1

(Continued)

FOREIGN PATENT DOCUMENTS

WO 2016034915 A1 3/2016

OTHER PUBLICATIONS

International Search Report and Written Opinion received for PCT application—PCT/US2016/042452, dated Oct. 26, 2016. 11 pages.

(Continued)

*Primary Examiner* — Michael N Opsasnick

(74) *Attorney, Agent, or Firm* — Finch & Maloney PLLC

(57) ABSTRACT

Techniques are disclosed for position-robust multiple microphone noise estimation techniques. The position-robust noise estimation techniques can be used when receiving speech including diffuse noise sources, which is commonly encountered in noisy environments. The position-robust noise estimation techniques include detecting speech using the power level difference (PLD) and the coherence statistics (CS) between two microphone input signals. This multi-dimensional approach results in dual microphone noise estimation which is not affected by the position of the audio input device, resulting in more accurate detection of speech periods and more accurate noise estimation results. The position-robust noise estimate obtained from the techniques can then be used as part of a noise reduction system to reduce the levels of noise in noisy speech signals.

25 Claims, 9 Drawing Sheets

(56) References Cited

U.S. PATENT DOCUMENTS 8,954,324 B2 * 2/2015 Wang ..... G10L 25/78 704/215
2006/0053007 A1 * 3/2006 Niemisto ..... G10L 25/78 704/233
2007/0021958 A1 * 1/2007 Visser ..... G10L 21/0272 704/226
2009/0089053 A1 * 4/2009 Wang ..... G10L 25/78 704/233
2010/0323652 A1 * 12/2010 Visser ..... H04R 3/005 455/232.1
2011/0038489 A1 * 2/2011 Visser ..... G01S 3/8006 381/92
2011/0231187 A1 9/2011 Sekiya et al.
2011/0264447 A1 * 10/2011 Visser ..... G10L 25/78 704/208
2011/0305345 A1 * 12/2011 Bouchard ..... G10L 21/0208 381/23.1
2012/0123773 A1 * 5/2012 Zeng ..... G10L 21/0208 704/226
2012/0130713 A1 * 5/2012 Shin ..... G10L 25/78 704/233
2013/0054231 A1 * 2/2013 Jeub ..... H04R 3/005 704/226
2013/0073283 A1 3/2013 Yamabe
2013/0096914 A1 * 4/2013 Avendano ..... G10L 21/0208 704/226
2013/0191118 A1 7/2013 Makino
2014/0334620 A1 * 11/2014 Yemdji ..... G10L 21/0232 379/406.08

OTHER PUBLICATIONS

Nelke, et al., "Dual Microphone Noise PSD Estimation for Mobile Phones in Hands-Free Position Exploiting the Coherence and Speech Presence Probability," IEEE ICASSP, May 2013, pp. 1-5.

International Preliminary Report on Patentability issued for PCT Application No. PCT/US2016/042452, dated Mar. 29, 2018. 8 pages.

* cited by examiner

Noisy Speech Signal 710

Signal After Noise Reduction Using PLD Only Noise Estimation Technique 720

Signal After Noise Reduction Using Position-Robust Noise Estimation Technique 730

POSITION-ROBUST MULTIPLE MICROPHONE NOISE ESTIMATION TECHNIQUES

BACKGROUND

Noise reduction is the process of removing noise from a signal. Noise may be any undesirable sound that is present in the signal, such as background noise present during speech. Generally, noise reduction includes noise estimation techniques to assist with identifying noise within a signal. All recording devices, both analog and digital, have traits which make them susceptible to noise. Noise can be random or white noise with no coherence, or coherent noise introduced by the device's mechanism or processing, or any other undesirable sound. Techniques for the reduction of background noise are used in many speech communication systems and electronic devices. Communication devices (e.g., smartphones, tablet computing devices, webcams, etc.) and hearing aids may utilize techniques to enhance the speech quality in adverse environments, or generally, in environments that include noise.

DETAILED DESCRIPTION

Figure 1A:
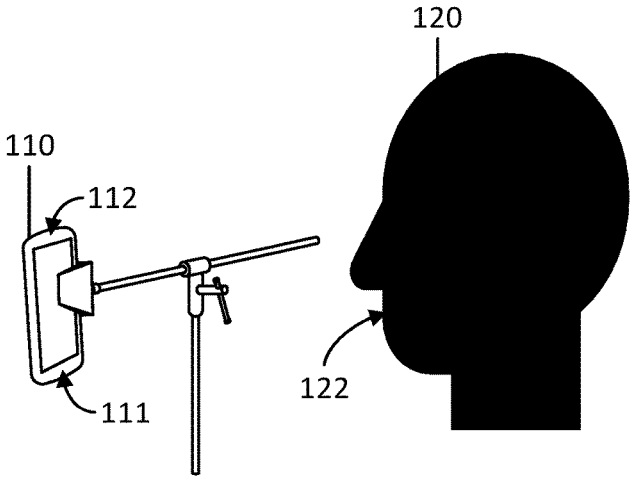
FIGS. 1A-D illustrate an example device including two microphones showing the device in multiple positions and/or orientations, in accordance with an embodiment of the present disclosure.
Figure 1B:
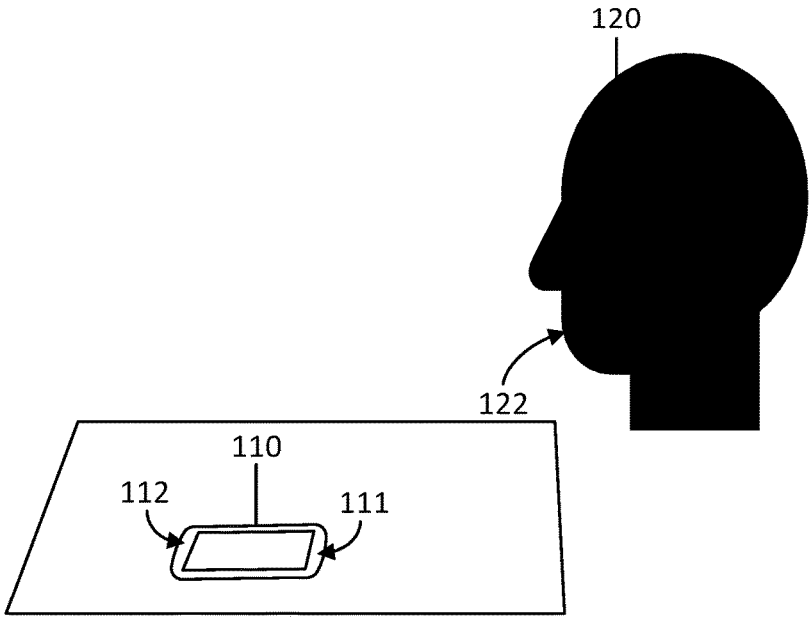
Figure 1C:
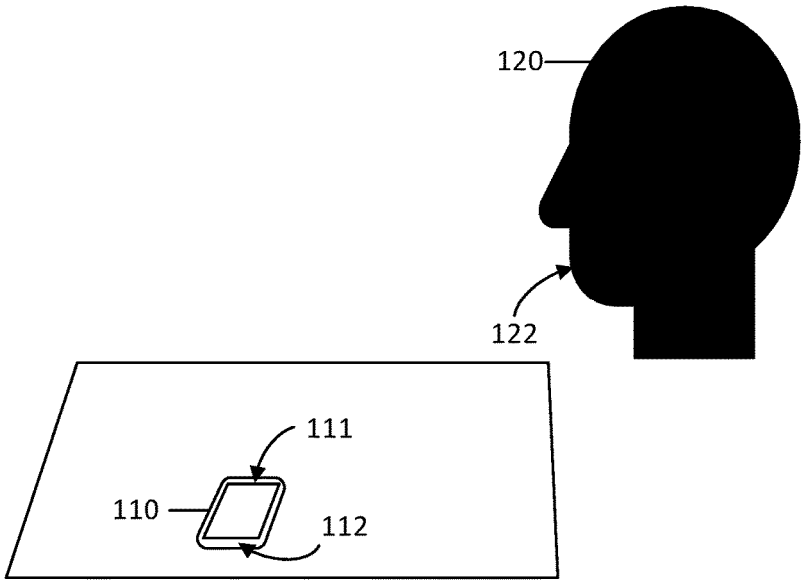
Figure 1D:
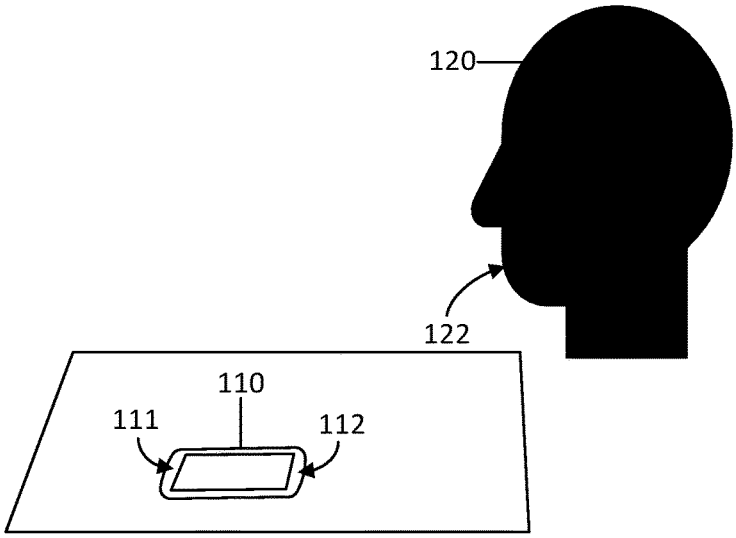

Techniques are disclosed for position-robust multiple microphone noise estimation techniques. The techniques can be used, for instance, when receiving speech including diffuse noise sources, which is commonly encountered in noisy environments. The techniques are distinct from noise estimation techniques that merely use the power level difference (PLD) between two microphones to detect the presence of speech. Such PLD only techniques work accurately at detecting speech periods when an audio input device (e.g., a smartphone) with more than one microphone is held in a position which creates a level difference between two microphones in the device. For example, this occurs when the primary microphone is near the mouth of the user and the secondary microphone is near the user's ear in a typical handset position, with the phone aligned with the side of the user's face. In alternative positions, such as various hands-free positions, PLD only noise estimation techniques have difficulty detecting speech, which leads to speech attenuation when noise reduction is applied. Therefore, the position-robust techniques variously described herein include detecting speech using both the PLD and coherence statistics between two microphone input signals. This multi-dimensional approach results in dual microphone noise estimation which is not affected by the position of the audio input device, resulting in more accurate detection of speech periods and more accurate noise estimation results. The position-robust noise estimate obtained from the techniques can then be used as part of a noise reduction system to reduce the levels of noise in noisy speech signals. Numerous variations and configurations will be apparent in light of this disclosure.

General Overview

Noise estimation techniques which operate in the short-time Fourier transform (STFT) domain are commonly used for noise reduction purposes, including noise estimation systems such as the minimum statistics and improved minima controlled recursive averaging. Such techniques estimate the noise spectrum based on the observation that the noisy signal power decays to values characteristic of the contaminating noise during speech pauses. Such techniques face a number of non-trivial challenges. For example, the techniques have difficulty tracking the noise power during speech segments, which results in poor estimates during long speech segments with few pauses. Accordingly, such techniques are supplemented to suppress the noise and enhance the output speech using techniques such as spectral subtraction and Wiener filtering. However, such single microphone noise reduction techniques can be improved when multiple microphones are available.

Many dual microphone noise estimation techniques use the power level difference (PLD) between the two microphones of a device to detect the presence of speech and then estimate the noise statistics during the pauses in speech. PLD based techniques detect the presence of speech when there is a significant difference between the power levels of the two microphones. However, such dual microphone noise estimation techniques only work when the speech source is located between the two microphones, such as is the case when a user holds a device (e.g., a smartphone, headset, etc.) to the user's head, with the primary microphone near the user's mouth and the secondary microphone near the user's ear. This is because PLD occurs due to the attenuation of speech which propagates from the mouth to the microphone near the ear, with the head presenting a transmission obstruction. However, when such positioning is not used, the attenuation of speech between the two microphones may not be suitable for PLD based techniques. Accordingly, the dual microphone noise estimation techniques do not perform as expected when a device including multiple microphones is in an alternative position and/or orientation than previously described. For example, FIGS. 1A-D illustrate a device 110 (which is a smartphone, in this example case), including a primary microphone 111 and a secondary microphone 112, positioned relative to a mock user 120 providing speech from a mouth location 122. FIGS. 1A-D respectively show the device 110 in: A) a handheld position; B) a hands-free position on a table with 0 degrees of rotation (such that the primary microphone is facing the user's mouth 122); C) a hands-free position on a table with 90 degrees of rotation; and D) a hands-free position on a table with 180 degrees of rotation. In alternative positions/orientations (such as those shown in FIGS. 1A-D), speech detection will be diminished using PLD only based noise estimation techniques, due to the techniques falsely detecting speech as noise, resulting in inaccurate noise estimation. This can negatively affect noise reduction performance, such as causing undesired speech attenuation when noise reduction is applied.

Thus, and in accordance with one or more embodiments of the present disclosure, techniques are disclosed for position-robust multiple microphone noise estimation techniques. In some embodiments, the position robustness of the noise estimation techniques can be achieved by utilizing both the power level difference (PLD) and the coherence statistics between two microphones. Such a multi-dimensional approach assists with detecting when speech is present in audio signals. Further, such techniques result in microphone noise estimation for two or more microphones, where the noise estimation is less affected or unaffected by the position and/or orientation of the microphones involved. The noise estimation techniques variously described herein are effective with diffuse noise sources, where the noise arrives from different directions, which is commonly encountered in noisy environments. In addition, at least two microphone signals are used for the noise estimation techniques, resulting in more frequent updates of the noise power, even during speech segments (e.g., as compared to techniques using one microphone). In some embodiments, the position-robust noise estimate obtained can be used as a part of a noise reduction system to reduce the levels of noise in noisy speech signals. Further, the resulting noise reduction system can maintain a balance between the level of noise and speech distortion while also maintaining expected performance when the position of the device is varied. Although the present disclosure focuses on noise estimation techniques, the noise power estimate obtained from the techniques can be used with any suitable parameters (e.g., any suitable suppression rule or gain rule) for noise reduction purposes, depending on the end use or target application.

In some embodiments, the noise estimation techniques can be used where audio input is received from two or more microphones. Accordingly, devices including two or more microphones (e.g., smartphones, tablet computers, headsets, etc.) can benefit from the techniques variously described herein. In embodiments where the techniques are used with two microphones, one microphone may be designated as the primary microphone and the other may be designated as the secondary microphone. In embodiments where the techniques are used with more than two microphones, the microphones may be split into primary and secondary microphone pairs and/or a single microphone may act as a primary microphone for two or more secondary microphones. Note that in some embodiments, the designation of microphones as primary and secondary may be based on the position, performance, and/or signals received from the microphones, and/or any other suitable attribute or characteristic of the microphones. For example, a microphone and/or input signal may be designated as primary based on its position (e.g., the primary microphone may be the microphone positioned at a preselected default speaking location of a device, the primary microphone may be the microphone detected as being closest to the user, etc.). In another example, a microphone and/or microphone input signal may be designated as primary based on its performance capabilities (e.g., the primary microphone may be able to pick up the largest range of frequencies, the primary microphone may be the most sensitive, etc.). In some embodiments, the assignment of primary and secondary to microphones and/or their input signals may be static, such that their designations do not change during application of the position-robust noise estimation techniques. In other embodiments, the assignment of primary and secondary to microphones and/or their input signals may be dynamic, such that their designations can change during application of the position-robust noise estimation techniques (e.g., where the primary and secondary assignments are selected based on proximity to the mouth of a user, which may be detected using any suitable techniques). Note that in some instances, the use of primary and secondary (or first and second) to identify microphones and/or microphone input signals may merely be used herein for ease of reference, such that any discrepancy between the two microphones and/or the microphone input signals is not purposefully related to the primary and secondary designations.

As previously described, in some embodiments, the position-robust noise estimation techniques include a multi-dimensional approach using both the PLD and the coherence statistics between two microphones. In some such embodiments, the techniques can be used to detect the presence of speech or noise in input signals provided by the two microphones. For example, the PLD-based techniques can be used to determine whether speech or noise is present in the input signal of the primary microphone of a device. Such PLD-based techniques can be used to detect speech when the mouth of the user is near the primary microphone, as the PLD will be positive during speech and close to zero in noise only periods. However, when the mouth of the user is not near the primary microphone, such as in the example cases shown in FIGS. 1A-D, the PLD may be close to zero during speech periods. Therefore, using only PLD-based techniques to detect speech for noise estimation can lead to misclassification of speech as noise. As a result, the position-robust techniques variously described herein combine PLD-based techniques with the coherence statistics between the two microphones to improve speech activity detection. As will be apparent in light of the present disclosure, the coherence between the two microphone input signals can be determined and then compared to a predefined coherence threshold, such that if the coherence value is greater than the threshold, for example, then speech is detected. In some embodiments, microphone input signals are transformed to produce K sub-band signals to make multiple frequency bins (or intervals) for a given time period m, and the average coherence value over multiple or all frequency bins is used in the comparison to the coherence threshold (e.g., to improve the distinction between speech and noise periods). In some such embodiments, the average coherence value over multiple or all frequency bins may be used due to the practical coherence values in noise having a high variability across different frequency ranges. Numerous variations and configurations of the position-robust noise estimation techniques will be apparent in light of the present disclosure.

As will be apparent in light of the present disclosure, the position-robust noise estimation techniques, as variously described herein, can be detected in any suitable way. For example, the techniques may be detected by evaluating the noise reduction capabilities of a device including multiple microphones in various different positions/orientations. If the noise reduction techniques perform well in noisy environments in device positions/orientations other than a conventional position with the primary microphone near the user's mouth, then it is likely that the position-robust noise estimation techniques as variously described herein are being used. Another example of detecting the position-robust noise techniques may include performing the following: (1) play a test signal composed of useful speech and background noise near a device including multiple microphones (e.g., a smartphone, tablet computer, hearing aid, etc.); (2) make a recording of the signal that the device produces and/or transmits (e.g., transmits to a cellular network, in the case of a smartphone); (3) physically block (e.g., with putty) the primary microphone of the device (e.g., the microphone closest to the bottom of a smartphone or closest to a user's mouth when conventionally used) such that the primary microphone cannot capture any signal; (4) repeat (1) and (2) to play a test signal and make a recording of the signal produced/transmitted while the primary microphone of the device is blocked; and (5) repeat (3) and (4) with the secondary microphone blocked instead of the primary microphone. The output signals recorded in (2), (4), and (5) can then be used to determine if the position-robust noise estimation technique as variously described herein is being used. Detection of the position-robust technique can be achieved by listening to the recording made in (4), where the primary microphone was blocked, to determine if no signal (or a very weak/faint signal, particularly where the microphone was not perfectly blocked) is present. Detection of the position-robust technique can also be achieved by comparing the recording made in (5), where the secondary microphone was blocked, to the recording made in (2), where no microphones were blocked, to determine if there is significantly less noise reduction in (4) compared to (2). Numerous methods for detecting the position-robust noise estimation techniques described herein will be apparent in light of the present disclosure.

The position-robust noise estimation techniques as variously described herein provide numerous benefits and advantages. For example, the multi-dimensional approach of detecting the presence of speech and non-speech using both the power level difference (PLD) and the coherence statistics between two (or more) microphones provides a more reliable speech detecting technique as compared to, e.g., an approach that only utilizes PLD between the two microphones. Further, the use of the average coherence value in any time frame results in lower complexity and faster convergence of the noise estimate compared to, e.g., noise estimation methods that analyze the coherence in every time-frequency bin. Further yet, position-robust noise estimate techniques reduce overestimation of noise power during speech periods by allowing the dual microphone noise estimate to decay to the value of a slower varying noise estimate. In addition, the techniques can be used to improve the position robustness of dual channel noise estimation technique for mobile devices, which can increase the likelihood of network acceptance, as such acceptance is reliant on position-robust tests. Numerous benefits of the position-robust noise estimation techniques will be apparent in light of the present disclosure.

Example Position-Robust Noise Estimation Techniques

Equation 1 below is provided as an example model to illustrate the components of a noisy speech signal x[n], where s[n] is the original noise-free speech and d[n] is the noise source which is assumed to be independent of the speech.

$$x[n]=s[n]+d[n] \quad (1)$$

The model described by Equation 1 is provided to assist with discussion of the position-robust noise estimation techniques.

Figure 2:
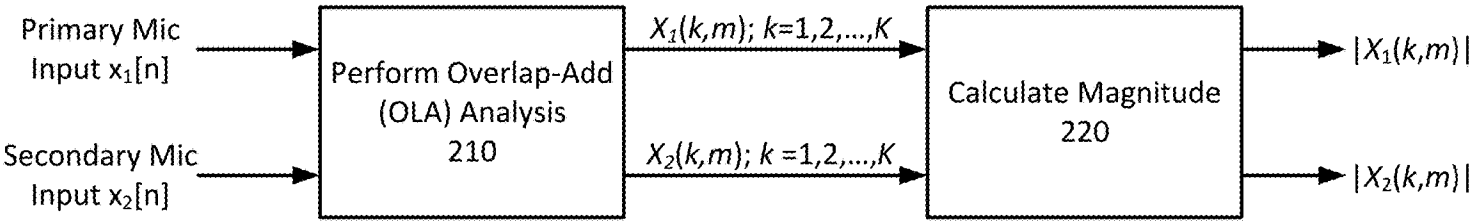
FIG. 2 illustrates a flow diagram of an example method of transforming microphone input signals into time-frequency bins, in accordance with an embodiment of the present disclosure.

FIG. 2 illustrates a flow diagram of an example method of transforming microphone input signals into time-frequency bins, in accordance with an embodiment of the present disclosure. As shown in FIG. 2, the method includes two input signals $x_1[n]$ and $x_2[n]$ that respectively correspond to a primary microphone and a secondary microphone of a device. The device may be any device including two or more microphones, such as a smartphone, a tablet computer, a headset, a personal computer, or some other suitable device that uses microphones to receive sound. Note that two microphones are primarily used herein to illustrate the position-robust noise estimation techniques. However, the principles and techniques variously described herein can be applied to applications including more than two microphones. For example, in embodiments, where the techniques are used with more than two microphones, the microphones may be split into primary and secondary microphone pairs and/or a single microphone may act as a primary microphone for two or more secondary microphones. To provide a more specific example, in the case of a device including four microphones, the first microphone may be used as a primary microphone for the other three microphones, or the first microphone may be used as a primary microphone for the second and third microphones and the second microphone may be used as a primary microphone for the fourth microphone, or the first microphone may be used as a primary microphone for the second microphone and the third microphone may be used as a primary microphone for the fourth microphone, or any other suitable configuration may be used depending on the end use or target application.

Continuing with the example flow diagram of FIG. 2, the two input signals $x_1[n]$ and $x_2[n]$ are received from two separate microphones, where $x_1[n]$ is from a primary microphone (e.g., primary microphone 111 of device 110 in FIGS. 1A-D) and $x_2[n]$ is from a secondary microphone (e.g., secondary microphone 112 of device 110 in FIGS. 1A-D). The input signals $x_1[n]$ and $x_2[n]$ can be transformed into the Short Time Fourier Transform (STFT) domain by performing Overlap-Add (OLA) Analysis 210 to produce K sub-band signals in $X_1(k,m)$ and $X_2(k,m)$ where k denotes the discrete frequency bin index and m denotes the discrete time or frame index. In some embodiments, the K sub-band signals may be selected to produce a spectral resolution with bin spacing smaller than 62.5 Hz, for example, or to produce any other desired spectral resolution and bin spacing, depending on the end use or target application. In other embodiments, other types of time frequency analysis may be used. After the signals have been transformed to discrete frequency bins k for discrete time periods m, the magnitude of the two signals can be calculated 212 to give their absolute values $|X_1(k,m)|$ and $|X_2(k,m)|$. The absolute values of the two signals can be used in the determination of the noise power estimate, which can be used in noise reduction systems for gain computation, for example.

Figure 3:
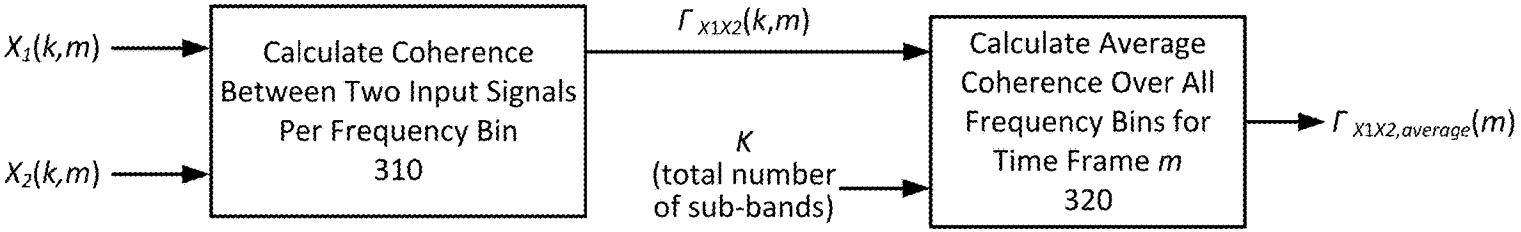
FIG. 3 illustrates a flow diagram of an example method for calculating coherence between two microphone input signals, in accordance with an embodiment of the present disclosure.
Figure 6:
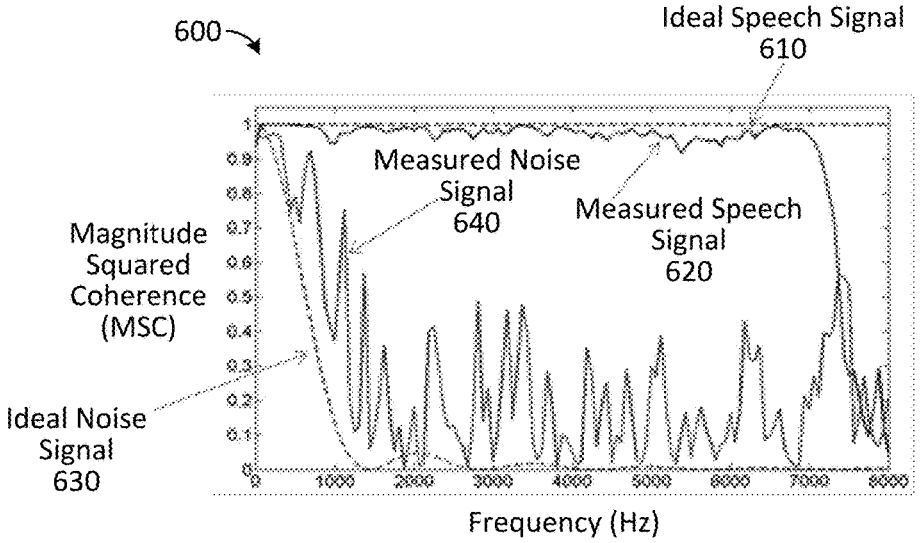
FIG. 6 illustrates an example plot comparing ideal and measured coherence properties for speech and diffuse noise, in accordance with an embodiment of the present disclosure.

FIG. 3 illustrates a flow diagram of an example method for calculating coherency for two microphone input signals, in accordance with an embodiment of the present disclosure. As previously described, the coherence between the two microphones can be used to reduce misdetections of speech as noise. Under ideal scenarios, there is a large separation between the coherence statistics of speech and noise. For example, FIG. 6 illustrates an example plot 600 comparing ideal and measured coherence properties for speech and diffuse noise, in accordance with an embodiment of the present disclosure. As can be seen in FIG. 6, the magnitude squared coherence (MSC) separation between the ideal speech signal 610 and ideal noise signal 630 is, for example, greater than 0.1 MSC at almost all frequencies, and is even close to 1 MSC at most frequencies. Further, as can be seen, under ideal scenarios, the coherence is higher in speech periods than noise only periods. However, in practical scenarios, the separation between the coherence statistics of both speech and noise is slightly lower, as can be seen by the measured speech signal 620 and measure noise signal 640 in the example plot 600 of FIG. 6, for example.

Continuing with the flow diagram of FIG. 3, coherence between the two microphone input signals $X_1(k,m)$ and $X_2(k,m)$ can be calculated 310 per frequency bin to determine coherence $\Gamma_{x_1x_2}(k,m)$. Equation 2 below is provided as an example for calculation 310:

$$\Gamma_{x_1x_2}(k,m) = \frac{\sigma_{x_1x_2}(k,m)}{\sqrt{\sigma_{x_1x_1}(k,m)\sigma_{x_2x_2}(k,m)}} \tag{2}$$

where $\sigma_{x_1x_2}(k,m)$ is the cross Power Spectral Density (PSD) of $x_1$ and $x_2$, and $\sigma_{x_1x_1}(k,m)$ and $\sigma_{x_2x_2}(k,m)$ are the auto PSD of $x_1$ and $x_2$, respectively. The cross and auto PSD can be measured and/or calculated using any suitable techniques, as will be apparent in light of the present disclosure.

In FIG. 6, it can be seen that the coherence values in measured noise signal 640 have a high variability across the evaluated frequency range (0-8000 Hz, in this example case). Therefore, in some embodiments, the average coherence $\Gamma_{x_1x_2,average}(m)$ over all frequency bins in every time frame m can be used to improve the distinction between speech and noise periods. As can be seen in FIG. 3, the flow diagram can optionally continue by calculating 320 the average coherence over all frequency bins for a given time frame m, represented by $\Gamma_{x_1x_2,average}(m)$. Calculation 320 includes input $\Gamma_{x_1x_2}(k,m)$ from Equation 2 above, as well as the input of K, which is the total number of sub-bands used in FIG. 2 during the OLA analysis. Equation 3 below is provided as an example for calculation 320:

$$\Gamma_{x_1x_2average}(m) = \frac{\sum_{k=1}^{\frac{K}{2}+1} \Gamma_{x_1x_2}(k,m)}{\frac{K}{2}+1} \tag{3}$$

As will be discussed in more detail below, the average coherence $\Gamma_{x_1x_2,average}(m)$ for a given time frame may be used in the position-robust noise estimation techniques to, for example, lower complexity and cause faster convergence of the noise estimate compared to noise estimation techniques which analyze the coherence in every time-frequency bin.

Figure 4:
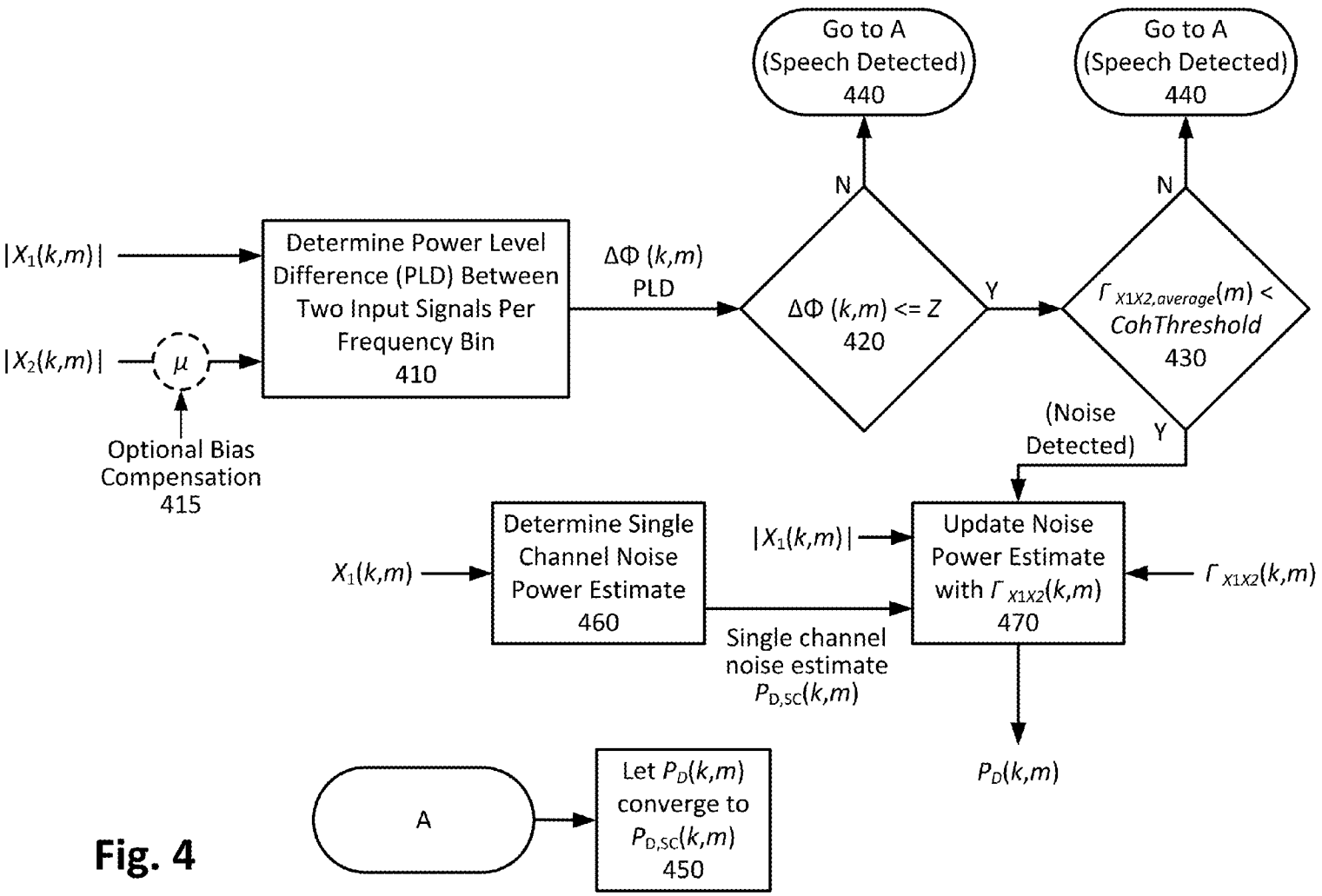
FIG. 4 illustrates a flow diagram of an example position-robust dual microphone noise estimation method, in accordance with an embodiment of the present disclosure.

FIG. 4 illustrates a flow diagram of an example position-robust dual microphone noise estimation method, in accordance with an embodiment of the present disclosure. The position-robust noise estimation method or techniques can be used to analyze the spectrum of input signals $X_1(k,m)$ and $X_2(k,m)$ to detect the presence of speech or noise in each frequency bin k. Based on whether or not speech is detected, the method will result in different techniques for arriving at the dual microphone noise spectrum estimate $P_D(k,m)$. As will be apparent in light of the present disclosure, the output of the method illustrated in FIG. 4, the dual microphone noise spectrum estimate $P_D(k,m)$, can be used in noise reduction systems for gain computation to be applied to noisy speech signals, as will be discussed with reference to FIG. 5.

The method of FIG. 4 includes determining 410 or measuring the power level difference $\Delta\Phi(k,m)$ between the two microphone input signals per frequency bin. Equation 4 below is provided as an example for determination 410:

$$\Delta\Phi(k,m) = |X_1(k,m)| - \mu \times |X_2(k,m)| \tag{4}$$

where the parameter $\mu$ is included to optionally compensate 415 for any bias or mismatch between the actual hardware of the two microphones providing the input signals. In some embodiments, bias or mismatch parameter $\mu$ may be selected based on the properties of the first or primary microphone that provides input $X_1(k,m)$ and/or based on the properties of the second or secondary microphone that provides input $X_2(k,m)$. The power level difference $\Delta\Phi(k,m)$ is evaluated at 420 to provide a first stage of signal/noise detection, as shown in FIG. 4. As can be seen, the value of $\Delta\Phi(k,m)$ can be compared to a predetermined variable Z, which can be set in the range of 0 to 0.3, for example, or any other suitable range depending on the end use or target application. If Z is set to 0, then the frequency bin will be detected as containing speech when the value of $\Delta\Phi(k,m)$ is positive. Such as selection for variable Z may be chosen due to PLD, $\Delta\Phi(k,m)$, being close to 0 in noise only periods and in the presence of a spherically isotropic diffuse noise field as long as a user's mouth is near the device's primary microphone and/or the device including the two microphones is used in a typical fashion (e.g., holding a smartphone to the users face with the primary microphone near the user's mouth and the secondary microphone near the user's ear). In other words, when a user's mouth is near the primary microphone and the user is speaking, PLD, $\Delta\Phi(k,m)$, will be positive, as the primary microphone input should be greater than the secondary microphone input.

When a user's mouth is not near the primary microphone, as a result of a change in orientation of the primary and secondary microphones (e.g., a change in the orientation of the device housing the microphones) and/or a change in the position of the primary microphone (e.g., the device housing the microphones is far from the user's mouth), PLD, $\Delta\Phi(k,m)$, may still be close to zero during speech periods. Accordingly, if only PLD was used for speech detection, this would result in misclassification of speech as noise, particularly in alternative positions/orientations, such as those shown in FIGS. 1A-D and described herein. For example, if speech were provided to the smartphone shown in FIG. 1D, where the primary microphone 111 is located farther away from the user's mouth 122 than the secondary microphone 112, the PLD, $\Delta\Phi(k,m)$, would most likely be determined 420 to be negative, as the magnitude of the secondary microphone input would be greater than the magnitude of the primary microphone input. As a result, if only PLD was used to detect speech, the result would be a detection of noise, not speech. Therefore, the use of the coherence statistics between the primary and secondary microphone input signals can be incorporated into the noise estimation techniques to improve speech activity detection.

Continuing with the method of FIG. 4, if the PLD, $\Delta\Phi(k,m)$, is determined 420 to be greater than the variable Z (e.g., if $\Delta\Phi(k,m)$ is positive, where Z=0), then the method continues by detecting that a speech period is present 440. Alternatively, if the PLD, $\Delta\Phi(k,m)$, is determined 420 to be less than or equal to the variable Z (e.g., if $\Delta\Phi(k,m)$ is less than or equal to 0, where Z=0), then the method continues to determine 430 if the average coherence $\Gamma_{x_1x_2,average}(m)$ is less than a predetermined coherence threshold CohThreshold. Although the coherence $\Gamma_{x_1x_2}(k,m)$ per time-frequency bin may be used in determination 430 in some embodiments, there are benefits of using the average coherence $\Gamma_{x_1x_2,average}(m)$ in determination 430, such as less complexity and faster convergence of the noise estimate. If $\Gamma_{x_1x_2,average}(m)$ is greater than or equal to CohThreshold, then a speech period is detected 440. If a speech period is detected at 420 or 430, resulting in the method continuing to 440, then the method can continue by selecting, calculating, and/or determining the dual microphone noise spectrum estimate $P_D(k,m)$ for the speech period. In this example method, when speech is detected, $P_D(k,m)$ decays to the value that would be determined using a single microphone noise estimation technique (s), which is represented by $P_{D,SC}(k,m)$. FIG. 4 illustrates the detection of speech 440 causing the flow diagram to continue to A, with A continuing to rectangle 450, where the method lets $P_D(k,m)$ converge to $P_{D,SC}(k,m)$.

As will be apparent in light of the present disclosure, any suitable single microphone/channel noise estimation techniques can be used to obtain $P_{D,SC}(k,m)$ in the method of FIG. 4, depending on the end use or target application. As shown in the flow diagram of FIG. 4, the method determines, calculates, or otherwise obtains 460 the single channel noise power estimate using the primary microphone input $X_1(k,m)$. Although in this example embodiment, the primary microphone input signal $X_1(k,m)$ is being used to determine 460 the single microphone/channel noise estimation techniques, in other embodiments, the secondary microphone input signal $X_2(k,m)$ can be used. Equation 5 below is provided as an example of the dual microphone spectrum estimate $P_D(k,m)$ decaying/converging 450 to the value of $P_{D,SC}(k,m)$:

$$P_D(k,m)=\alpha_{smooth}P_D(k,m-1)+(1-\alpha_{smooth})P_{D,SC}(k,m) \tag{5}$$

where $\alpha_{smooth}$ is a smoothing factor that can be selected based on, for example, the microphones and/or device being used. The smoothing factor $\alpha_{smooth}$ may be selected to be between 0 and 1 and may be selected as, for example, 0.75 for a smartphone or tablet computing device. In some cases, having $P_D(k,m)$ decay to the value of $P_{D,SC}(k,m)$ can help overestimation of the noise power which may occur if $P_D(k,m)$ freezes during speech periods.

Continuing from diamond 430 of the example method of FIG. 4, if $\Gamma_{x_1x_2,average}(m)$ is less than CohThreshold, then a noise period is detected and the method continues by updating 470 the noise power estimate with the coherence for that time-frequency bin $\Gamma_{x_1x_2}(k,m)$. Equations 7 and 8 below are provided as examples of updating 470 the noise power $P_D(k,m)$ calculation using coherence value $\Gamma_{x_1x_2}(k,m)$:

$$P_{est}(k,m)=\Gamma_{x_1x_2}(k,m)P_{D,SC}(k,m)+(1-\Gamma_{x_1x_2}(k,m))|X_1(k,m)|^2 \tag{7}$$

$$P_D(k,m)=\alpha_{smooth}P_D(k,m-1)+(1-\alpha_{smooth})P_{est}(k,m) \tag{8}$$

In Equation 7, the coherence value $\Gamma_{x_1x_2}(k,m)$, which varies between 0 and 1, is used as a smoothing factor for the intermediate power estimate $P_{est}(k,m)$, in this example embodiment. Therefore, methods for position-robust detection of speech periods versus noise only periods) have been described, and methods for calculating the noise power estimate for speech periods and noise only periods have also been described. Note that noise only periods, as variously used herein, may also be referred to as non-speech periods. For example, in some cases, when speech is not detected, a noise only period is detected.

In some embodiments, the coherence threshold (e.g., CohThreshold, used in the example method of FIG. 4) may be selected based on the particular device configuration. For example, the coherence threshold may be selected based on the device or system implementing the position-robust noise-estimation techniques, based on the microphones used to receive the audio input signals, and/or based on any other suitable parameter, depending on the end use or target application. In some embodiments, the coherence threshold may be preset and/or selected by a user to tune the noise estimation techniques. Accordingly, the coherence threshold may be hard coded and/or user-configurable (e.g., the coherence threshold may be preset, but it may also be user-configurable such that a user can change the preset value). In some cases, increasing the coherence threshold may cause an increase in the detection of noise only periods. For example, increasing the CohThreshold value in the method of FIG. 4 may result in an increase in the detection of noise only periods, as more average coherence values, $\Gamma_{x_1x_2,average}(n)$, may be less than the increased CohThreshold value. Conversely, in some cases, decreasing the coherence threshold may cause an increase in the detection of speech periods. For example, decreasing the CohThreshold value in the method of FIG. 4 may result in an increase in the detection of speech periods, as more average coherence values, $\Gamma_{x_1x_2,average}(n)$, may be greater than or equal to the decreased CohThreshold value. Accordingly, the coherence threshold can be used as a tuning parameter for the position-robust noise estimation techniques.

Figure 5:
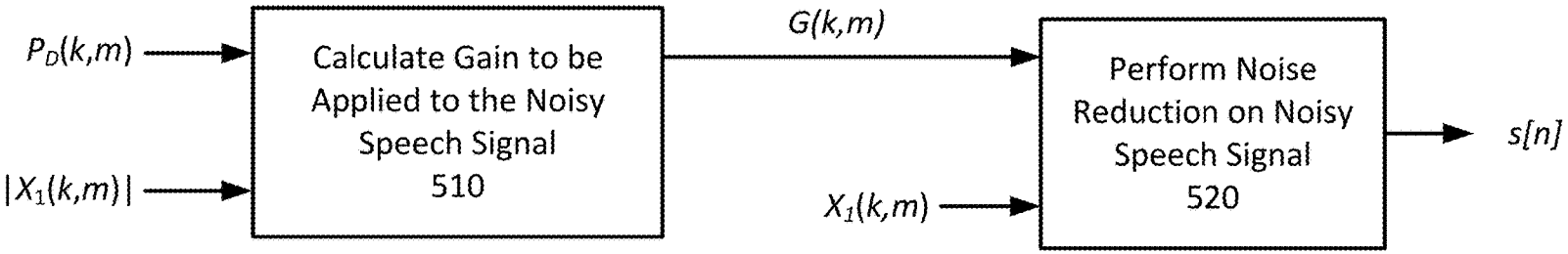
FIG. 5 illustrates a flow diagram of an example noise reduction method, in accordance with an embodiment of the present disclosure.

FIG. 5 illustrates a flow diagram of an example noise reduction method, in accordance with an embodiment of the present disclosure. In this example embodiment, the position-robust dual microphone noise estimate $P_D(k,m)$ determined in FIG. 4 can be used in a noise reduction system to calculate 510 a gain G (k,m) to be applied to the noisy speech signal $X_1(k,m)$. Equation 9 below is provided as an example of calculating 510 gain G (k,m) using spectral subtraction:

$$G(k,m)=\sqrt{1-\frac{P_D(k,m)}{|X_1(k,m)|^2}} \tag{9}$$

The noise reduction method shown in FIG. 5 can then use the gain G (k,m) calculated at 510 to perform 520 noise reduction on the noisy speech signal $X_1(k,m)$, resulting in a cleaner speech signal s[n] that has reduced noise or is completely free of the noise originally present in the signal. Note that other processes may be performed at 520 to obtain the cleaner speech s[n], such as reconstruction from inverse time frequency analysis (e.g., from inverse STFT), overlap-add processing, or other suitable techniques, depending on the end use or target application.

Example Performance Results

Various tests are used to evaluate the performance of noise reduction techniques, such as 3QUEST (3-fold quality evaluation of speech in telecommunications) mean opinion score (MOS) tests. For example, speech MOS (SMOS) test scores indicate the quality of a speech signal and noise MOS (NMOS) test scores indicate the intrusiveness of background noise. The scores range from 1 to 5, with higher scores indicating better quality. SMOS and NMOS scores are typically evaluated in various different noise environments, such as in a cafeteria or in a car.

An example test was performed using a smartphone device including two microphones where the phone was held in the handheld hands-free position as shown in FIG. 1A. The example test was performed to provide an objective assessment of a first noise estimation technique that only utilizes power level difference (PLD) for detecting the presence of speech and non-speech as compared to a second noise estimation technique that utilizes both the PLD and coherence statistics (CS) between the two microphones, in accordance with an embodiment of the present disclosure. The SMOS and NMOS scores were evaluated using noisy speech signals recorded in eight different noise environments—cafeteria, call center, car, crossroads, mensa, pub, road, and train—as are commonly used. The 3QUEST SMOS and NMOS scores were computed after processing the recorded signals using the first and second noise estimation techniques (using a spectral subtraction gain rule). The scores were averaged over all of the eight noise environments and the results are shown in Table 1 below:

TABLE 1

Objective Assessment of Two Noise Estimation Techniques

| Noise Estimation Method | Average SMOS score | Average NMOS score |
|---|---|---|
| First Technique (PLD only) | 3 | 2.5 |
| Second Technique (PLD + CS) | 3.6 | 3.4 |

As can be seen in Table 1 above, using the second noise estimation technique, which includes using both power level difference (PLD) and coherence statistics (CS) to detect the presence of speech and non-speech (as variously described herein), results in higher SMOS and NMOS scores than the first technique (PLD only). Subjective listening tests were also performed to confirm the objective results, where the listeners preferred the speech and noise quality resulting from use of the second noise estimation technique compared to use of the first noise estimation technique. The results of this example test are provided for illustrative purposes only and are not intended to limit the present disclosure.

Figure 7A:
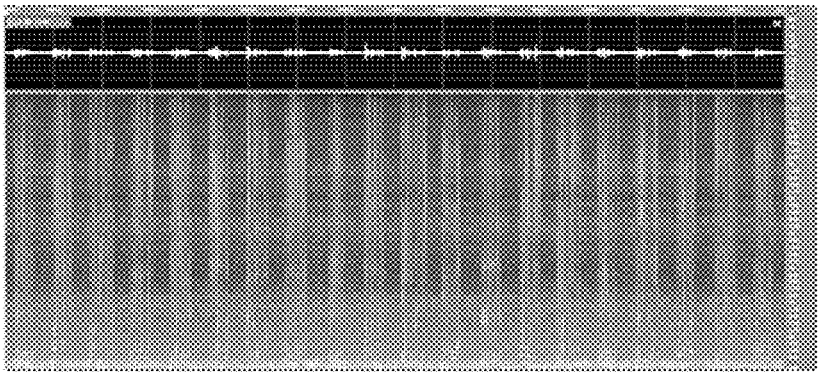
FIGS. 7A-C illustrate the performance of the position-robust noise estimation techniques as compared to power level difference (PLD) only noise estimation techniques in a car environment, in accordance with an embodiment.
Figure 7B:
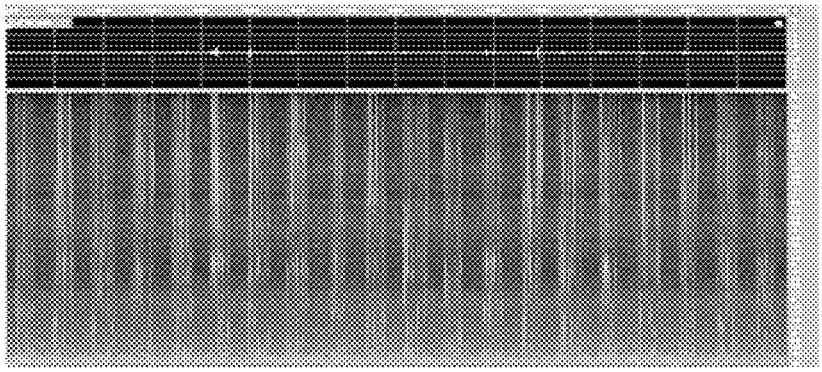
Figure 7C:
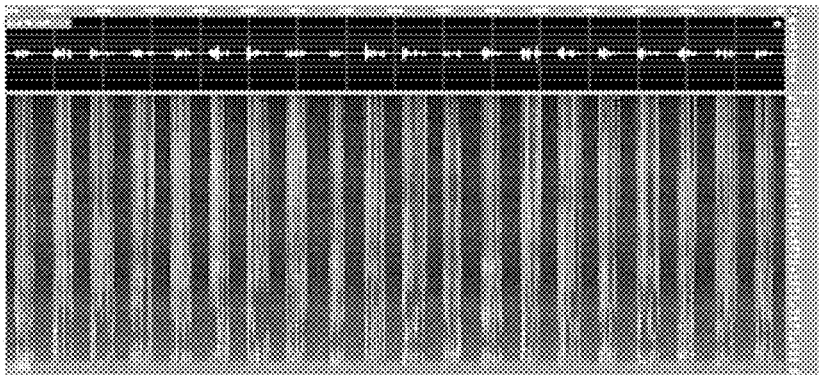

FIGS. 7A-C illustrate the performance of the position-robust noise estimation techniques as compared to PLD only noise estimation techniques in a car environment, in accordance with an embodiment. More specifically, FIG. 7A illustrates the input noisy speech signal 710 recorded by a dual microphone mobile device in a handheld hands-free position as shown in FIG. 1A. The speech signal was played from the mouth of the dummy head in the presence of background car noise. The noise estimate obtained from the PLD only noise estimation technique (referred to as the first technique in Table 1) was applied to the noisy speech signal using spectral subtraction and the output signal 720 is shown in FIG. 7B. As can be seen in FIG. 7B, the PLD only technique causes high rates of false detection of speech as noise, resulting in significant speech attenuation. The noise estimate obtained from the position-robust noise estimation technique (as variously described herein) was applied to the noisy signal using the same gain rule from the test with the PLD only technique. The result 730 of the example test using the position-robust noise estimation technique is shown in FIG. 7C. As can be seen in FIG. 7C, the position-robust noise estimation technique is able to perform more accurate noise estimation, producing a more accurate speech signal 730, and thereby overcoming the deficiency of speech attenuation caused by the PLD only noise estimation technique, which resulted in the less accurate speech signal 720.

Example System

Figure 8:
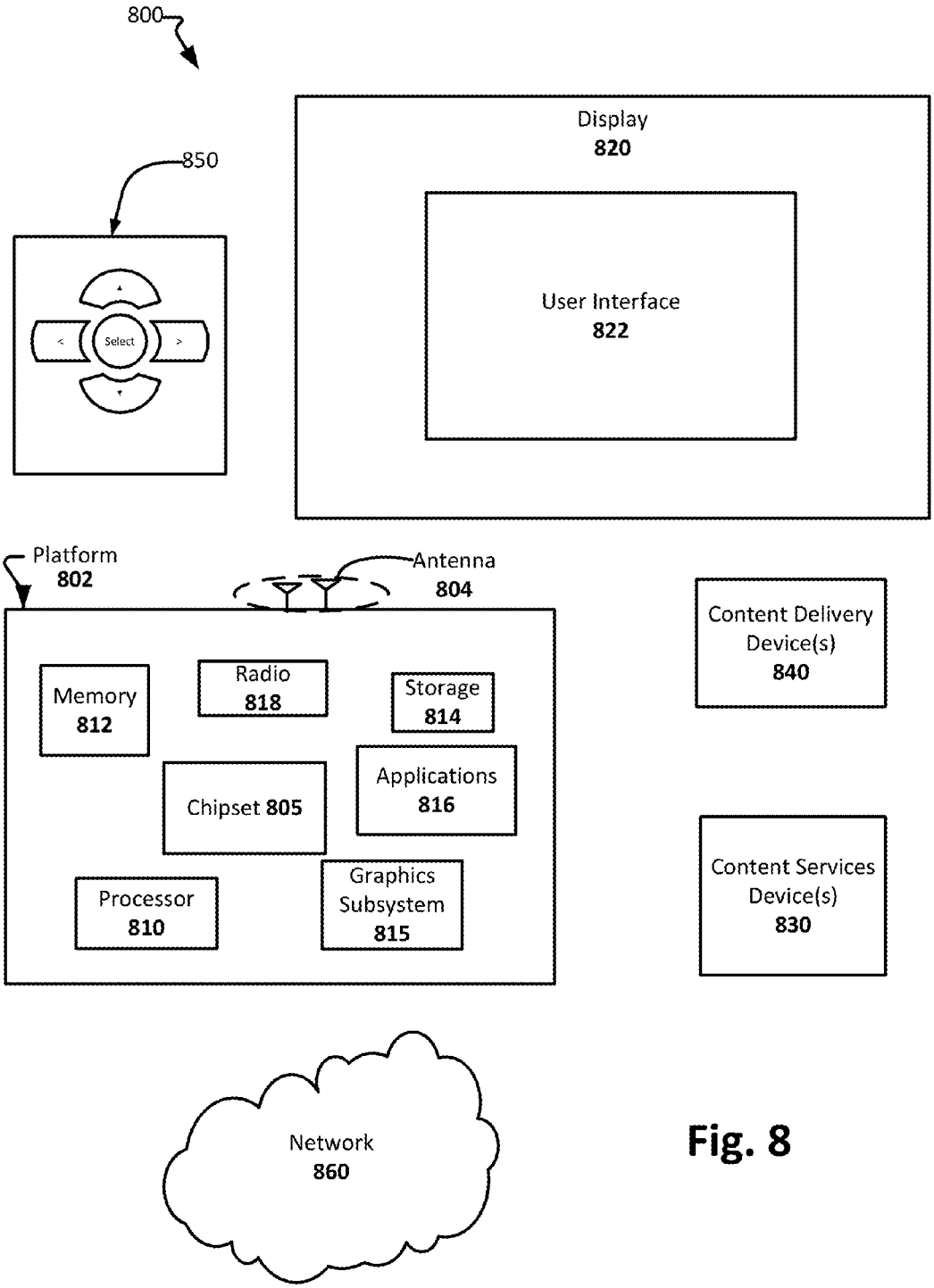
FIG. 8 illustrates a media system configured in accordance with an embodiment of the present disclosure.

FIG. 8 illustrates an example system 800 that may carry out the position-robust noise estimation techniques, in accordance with an embodiment. In some embodiments, system 800 may be a media system although system 800 is not limited to this context. For example, system 800 may be incorporated into a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, set-top box, game console, or other such computing environments capable of performing graphics rendering operations.

In some embodiments, system 800 includes a platform 802 coupled to a display 820. Platform 802 may receive content from a content device such as content services device(s) 830 or content delivery device(s) 840 or other similar content sources. A navigation controller 850 comprising one or more navigation features may be used to interact with, for example, platform 802 and/or display 820. Each of these example components is described in more detail below.

In some embodiments, platform 802 includes any combination of a chipset 805, processor 810, memory 812, storage 814, graphics subsystem 815, applications 816 and/or radio 818. Chipset 805 provides intercommunication among processor 810, memory 812, storage 814, graphics subsystem 815, applications 816 and/or radio 818. For example, chipset 805 may include a storage adapter (not depicted) capable of providing intercommunication with storage 814.

Processor 810 may be implemented, for example, as Complex Instruction Set Computer (CISC) or Reduced Instruction Set Computer (RISC) processors, x86 instruction set compatible processors, multi-core, or any other microprocessor or central processing unit (CPU). In some embodiments, processor 810 includes dual-core processor(s), dual-core mobile processor(s), quad-core processor(s), and so forth. Memory 812 may be implemented, for instance, as a volatile memory device such as, but not limited to, a Random Access Memory (RAM), Dynamic Random Access Memory (DRAM), or Static RAM (SRAM). Storage 814 may be implemented, for example, as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In some embodiments, storage 814 includes technology to increase the storage performance enhanced protection for valuable digital media when multiple hard drives are included, for example.

Graphics subsystem 815 may perform processing of images such as still or video for display. Graphics subsystem 815 may be a graphics processing unit (GPU) or a visual processing unit (VPU), for example. An analog or digital interface may be used to communicatively couple graphics subsystem 815 and display 820. For example, the interface may be any of a High-Definition Multimedia Interface, DisplayPort, wireless HDMI, and/or wireless HD compliant techniques. Graphics subsystem 815 can be integrated into processor 810 or chipset 805. Graphics subsystem 815 can be a stand-alone card communicatively coupled to chipset 805. The graphics and/or video processing techniques described herein may be implemented in various hardware architectures. For example, hardware assisted privilege access violation check functionality as provided herein may be integrated within a graphics and/or video chipset. Alternatively, a discrete security processor may be used. In still another embodiment, the graphics and/or video functions including hardware assist for privilege access violation checks may be implemented by a general purpose processor, including a multi-core processor.

Radio 818 can include one or more radios capable of transmitting and receiving signals using various suitable wireless communications techniques. Such techniques may involve communications across one or more wireless networks. Exemplary wireless networks include (but are not limited to) wireless local area networks (WLANs), wireless personal area networks (WPANs), wireless metropolitan area network (WMANs), cellular networks, and satellite networks. In communicating across such networks, radio 818 may operate in accordance with one or more applicable standards in any version.

In some embodiments, display 820 includes any television or computer type monitor or display. Display 820 may comprise, for example, a liquid crystal display (LCD) screen, electrophoretic display (EPD or liquid paper display, flat panel display, touch screen display, television-like device, and/or a television. Display 820 can be digital and/or analog. In some embodiments, display 820 is a holographic or three-dimensional display. Also, display 820 can be a transparent surface that may receive a visual projection. Such projections may convey various forms of information, images, and/or objects. For example, such projections may be a visual overlay for a mobile augmented reality (MAR) application. Under the control of one or more software applications 816, platform 802 can display a user interface 822 on display 820.

In some embodiments, content services device(s) 830 can be hosted by any national, international and/or independent service and thus accessible to platform 802 via the Internet or other network, for example. Content services device(s) 830 can be coupled to platform 802 and/or to display 820. Platform 802 and/or content services device(s) 830 can be coupled to a network 860 to communicate (e.g., send and/or receive) media information to and from network 860. Content delivery device(s) 840 can be coupled to platform 802 and/or to display 820. In some embodiments, content services device(s) 830 includes a cable television box, personal computer, network, telephone, Internet enabled devices or appliance capable of delivering digital information and/or content, and any other similar device capable of unidirectionally or bidirectionally communicating content between content providers and platform 802 and/display 820, via network 860 or directly. It will be appreciated that the content may be communicated unidirectionally and/or bidirectionally to and from any one of the components in system 800 and a content provider via network 860. Examples of content may include any media information including, for example, video, music, graphics, text, medical and gaming content, and so forth.

Content services device(s) 830 receives content such as cable television programming including media information, digital information, and/or other content. Examples of content providers may include any cable or satellite television or radio or Internet content providers. The provided examples are not intended to limit the scope of the present disclosure. In some embodiments, platform 802 receives control signals from navigation controller 850 having one or more navigation features. The navigation features of controller 850 may be used to interact with user interface 822, for example. In some embodiments, navigation controller 850 can be a pointing device that may be a computer hardware component (specifically human interface device) that allows a user to input spatial (e.g., continuous and multi-dimensional) data into a computer. Many systems such as graphical user interfaces (GUI), and televisions and monitors allow the user to control and provide data to the computer or television using physical gestures.

Movements of the navigation features of controller 850 can be echoed on a display (e.g., display 820) by movements of a pointer, cursor, focus ring, or other visual indicators displayed on the display. For example, under the control of software applications 816, the navigation features located on navigation controller 850 may be mapped to virtual navigation features displayed on user interface 822. In some embodiments, controller 850 is not a separate component but rather is integrated into platform 802 and/or display 820.

In some embodiments, drivers (not shown) include technology to enable users to instantly turn on and off platform 802 like a television with the touch of a button after initial boot-up, when enabled, for example. Program logic may allow platform 802 to stream content to media adaptors or other content services device(s) 830 or content delivery device(s) 840 when the platform is turned "off." In addition, chip set 805 may comprise hardware and/or software support for 5.1 surround sound audio and/or high definition 7.1 surround sound audio, for example. Drivers may include a graphics driver for integrated graphics platforms. In some embodiments, the graphics driver includes a peripheral component interconnect (PCI) express graphics card.

In various embodiments, any one or more of the components shown in system 800 can be integrated. For example, platform 802 and content services device(s) 830 may be integrated, or platform 802 and content delivery device(s) 840 may be integrated, or platform 802, content services device(s) 830, and content delivery device(s) 840 may be integrated, for example. In various embodiments, platform 802 and display 820 may be an integrated unit. Display 820 and content service device(s) 830 may be integrated, or display 820 and content delivery device(s) 840 may be integrated, for example. These examples are not meant to limit the scope of the present disclosure.

In various embodiments, system 800 can be implemented as a wireless system, a wired system, or a combination of both. When implemented as a wireless system, system 800 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 800 can include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media include a wire, cable, metal leads, printed circuit board (PCB), backplane, switch fabric, semiconductor material, twisted-pair wire, co-axial cable, fiber optics, and so forth.

Platform 802 can establish one or more logical or physical channels to communicate information. The information may include media information and control information. Media information refers to any data representing content meant for consumption by a user. Examples of content include, for example, data from a voice conversation, videoconference, streaming video, email or text messages, voice mail message, alphanumeric symbols, graphics, image, video, text and so forth. Control information refers to any data representing commands, instructions or control words meant for used by an automated system. For example, control information may be used to route media information through a system, or instruct a node to process the media information in a predetermined manner (e.g., using hardware assisted for privilege access violation checks as described herein). The embodiments, however, are not limited to the elements or context shown or described in FIG. 8.

Figure 9:
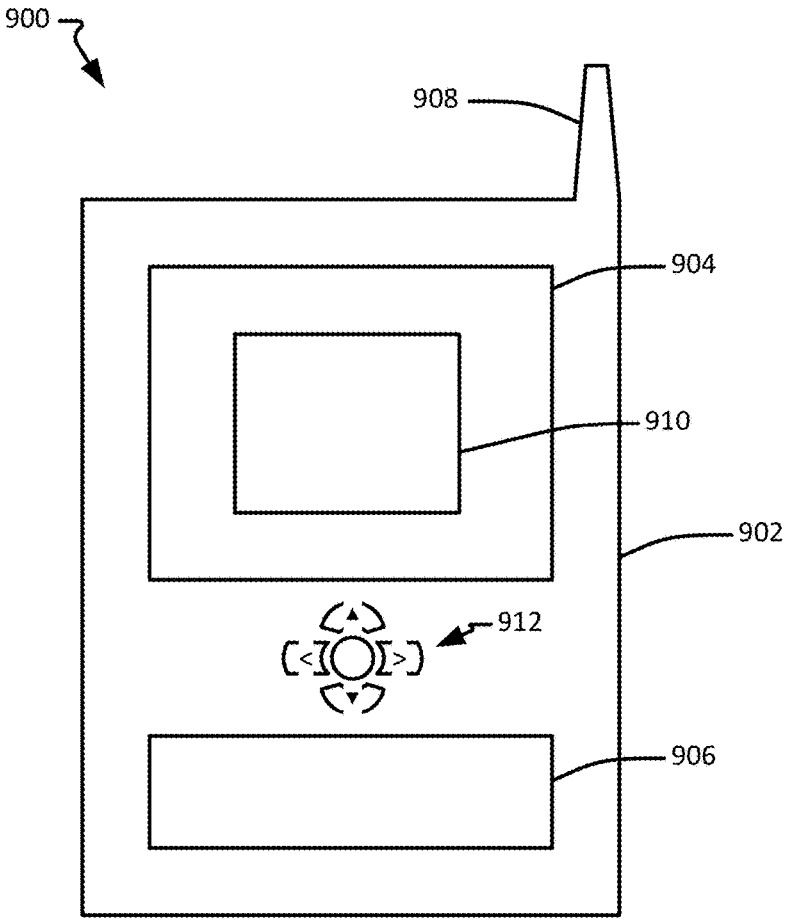
FIG. 9 illustrates a mobile computing device configured in accordance with an embodiment of the present disclosure.

As described above, system 800 may be embodied in varying physical styles or form factors. FIG. 9 illustrates embodiments of a small form factor device 900 in which system 800 may be embodied. In some embodiments, for example, device 900 may be implemented as a mobile computing device having wireless capabilities. A mobile computing device refers to any device having a processing system and a mobile power source or supply, such as one or more batteries, for example.

As previously described, examples of a mobile computing device include a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

Examples of a mobile computing device also include computers that are arranged to be worn by a person, such as a wrist computer, finger computer, ring computer, eyeglass computer, belt-clip computer, arm-band computer, shoe computers, clothing computers, and other wearable computers. In some embodiments, for example, a mobile computing device may be implemented as a smart phone capable of executing computer applications, as well as voice communications and/or data communications. Although some embodiments are described with a mobile computing device implemented as a smart phone, it will be appreciated that other embodiments may be implemented using other wireless mobile computing devices as well.

As shown in FIG. 9, device 900 includes a housing 902, a display 904, an input/output (I/O) device 906, and an antenna 908. Device 900 may, for example, include navigation features 912. Display 904 includes any suitable display unit for displaying information appropriate for a mobile computing device. I/O device 906 includes any suitable I/O device for entering information into a mobile computing device. Examples for I/O device 906 include an alphanumeric keyboard, a numeric keypad, a touch pad, input keys, buttons, switches, rocker switches, microphones, speakers, voice recognition device and software, and so forth. Information may be entered into device 900 by way of one or more microphones of the device, such as to receive the microphone input signals variously described herein (e.g., first/primary microphone input signal, second/secondary microphone input signal, etc.). Such information may be digitized by a voice recognition device.

Various embodiments can be implemented using hardware elements, software elements, or a combination of both. Examples of hardware elements includes processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Whether hardware elements and/or software elements are used may vary from one embodiment to the next in accordance with any number of factors, such as desired computational rate, power levels, heat tolerances, processing cycle budget, input data rates, output data rates, memory resources, data bus speeds and other design or performance constraints.

Some embodiments may be implemented, for example, using a machine-readable medium or article or computer program product which may store an instruction or a set of instructions that, if executed by a machine, may cause the machine to perform a method and/or operations in accordance with an embodiment of the present disclosure. Such a machine may include, for example, any suitable processing platform, computing platform, computing device, processing device, computing system, processing system, computer, processor, or the like, and may be implemented using any suitable combination of hardware and software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of executable code implemented using any suitable high-level, low-level, object-oriented, visual, compiled and/or interpreted programming language. Some embodiments may be implemented in a computer program product that incorporates the functionality of the techniques for position-robust noise estimation using two or more microphones, as variously disclosed herein, and such a computer program product may include one or more machine-readable mediums or be operated by one or more processors, for example.

Unless specifically stated otherwise, it will be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or displays.

Further Example Embodiments

The following examples pertain to further embodiments, from which numerous permutations and configurations will be apparent.

Example 1 is a method for noise estimation in an audio signal, the method including: determining the power level difference (PLD) between a first microphone input signal and a second microphone input signal for a given time period, wherein a coherence value exists between the first and second input signals in the given time period; and determining if speech is detected in the first input signal in the given time period, wherein speech is detected if the PLD between the first and second input signals is a positive value, and wherein speech is detected if the PLD is not a positive value and the coherence between the first and second input signals is greater than a predetermined coherence value threshold.

Example 2 includes the subject matter of Example 1, further including compensating for at least one of bias and mismatch between the first microphone and the second microphone during the PLD determination.

Example 3 includes the subject matter of any of Examples 1-2, further including, when speech is detected, calculating a noise power estimate for the given time period using a single channel noise estimate technique.

Example 4 includes the subject matter of Example 3, wherein calculating the noise power estimate for the given time period includes using the noise power estimate for a previous time period.

Example 5 includes the subject matter of any of Examples 3-4, further including calculating a gain using the noise power estimate, wherein the gain is used to perform noise reduction on the first microphone input signal in the given time period.

Example 6 includes the subject matter of any of Examples 1-5, further including, when speech is not detected, calculating a noise power estimate using the coherence value between the first and second microphone input signals.

Example 7 includes the subject matter of Example 6, wherein calculating the noise power estimate for the given time period includes using the noise power estimate for a previous time period.

Example 8 includes the subject matter of any of Examples 6-7, further including calculating a gain using the noise power estimate, wherein the gain is used to perform noise reduction on the first microphone input signal in the given time period.

Example 9 includes the subject matter of any of Examples 1-8, wherein the coherence value is the average coherence value of a plurality of frequencies in the given time period.

Example 10 includes the subject matter of any of Examples 1-9, further including transforming the first and second microphone input signals into a plurality of time-frequency bins, and wherein the coherence value is the average coherence over all frequency bins for the given time period.

Example 11 includes the subject matter of any of Examples 1-10, wherein the coherence threshold is user-configurable.

Example 12 includes the subject matter of any of Examples 1-11, wherein increasing the coherence threshold causes a decrease in the detection of speech.

Example 13 includes the subject matter of any of Examples 1-12, wherein decreasing the coherence threshold causes an increase in the detection of speech.

Example 14 is a non-transitory computer program product having instructions encoded thereon that when executed by one or more processors cause a process to be carried out, the process including: determine the power level difference (PLD) between a first microphone input signal and a second microphone input signal for a given time period, wherein a coherence value exists between the first and second input signals in the given time period; and determine if speech is detected in the first input signal in the given time period, wherein speech is detected if the PLD between the first and second input signals is a positive value, and wherein speech is detected if the PLD is not a positive value and the coherence between the first and second input signals is greater than a predetermined coherence value threshold.

Example 15 includes the subject matter of Example 14, the process further including: compensate for at least one of bias and mismatch between the first microphone and the second microphone during the PLD determination.

Example 16 includes the subject matter of any of Examples 14-15, the process further including: when speech is detected, calculate a noise power estimate for the given time period using a single channel noise estimate technique.

Example 17 includes the subject matter of Example 16, wherein calculating the noise power estimate for the given time period includes using the noise power estimate for a previous time period.

Example 18 includes the subject matter of any of Examples 16-17, the process further including: calculate a gain using the noise power estimate, wherein the gain is used to perform noise reduction on the first microphone input signal in the given time period.

Example 19 includes the subject matter of any of Examples 14-18, the process further including: when speech is not detected, calculate a noise power estimate using the coherence value between the first and second microphone input signals.

Example 20 includes the subject matter of Example 19, wherein calculating the noise power estimate for the given time period includes using the noise power estimate for a previous time period.

Example 21 includes the subject matter of any of Examples 19-20, the process further including: calculate a gain using the noise power estimate, wherein the gain is used to perform noise reduction on the first microphone input signal in the given time period.

Example 22 includes the subject matter of any of Examples 14-21, wherein the coherence value is the average coherence value of a plurality of frequencies in the given time period.

Example 23 includes the subject matter of any of Examples 14-22, the process further including: transform the first and second microphone input signals into a plurality of time-frequency bins, and wherein the coherence value is the average coherence over all frequency bins for the given time period.

Example 24 includes the subject matter of any of Examples 14-23, wherein the coherence threshold is user-configurable.

Example 25 includes the subject matter of any of Examples 14-24, wherein increasing the coherence threshold causes a decrease in the detection of speech.

Example 26 includes the subject matter of any of Examples 14-25, wherein decreasing the coherence threshold causes an increase in the detection of speech.

Example 27 is a system for noise estimation, the system including: a first microphone configured to receive a first input signal; a second microphone configured to receive a second input signal; and a processor configured to: determine the power level difference (PLD) between the first input signal and the second input signal for a given time period, wherein a coherence value exists between the first and second input signals in the given time period; and determine if speech is detected in the first input signal in the given time period, wherein speech is detected if the PLD between the first and second input signals is a positive value, and wherein speech is detected if the PLD is not a positive value and the coherence between the first and second input signals is greater than a predetermined coherence value threshold.

Example 28 includes the subject matter of Example 27, the processor further configured to: compensate for at least one of bias and mismatch between the first microphone and the second microphone during the PLD determination.

Example 29 includes the subject matter of any of Examples 27-28, the processor further configured to: when speech is detected, calculate a noise power estimate for the given time period using a single channel noise estimate technique.

Example 30 includes the subject matter of Example 29, wherein calculating the noise power estimate for the given time period includes using the noise power estimate for a previous time period.

Example 31 includes the subject matter of any of Examples 29-30, the processor further configured to: calculate a gain using the noise power estimate, wherein the gain is used to perform noise reduction on the first microphone input signal in the given time period.

Example 32 includes the subject matter of any of Examples 27-31, the processor further configured to: when speech is not detected, calculate a noise power estimate using the coherence value between the first and second microphone input signals.

Example 33 includes the subject matter of Example 32, wherein calculating the noise power estimate for the given time period includes using the noise power estimate for a previous time period.

Example 34 includes the subject matter of any of Examples 32-33, the processor further configured to: calculate a gain using the noise power estimate, wherein the gain is used to perform noise reduction on the first microphone input signal in the given time period.

Example 35 includes the subject matter of any of Examples 27-34, wherein the coherence value is the average coherence value of a plurality of frequencies in the given time period.

Example 36 includes the subject matter of any of Examples 27-35, the processor further configured to: transform the first and second microphone input signals into a plurality of time-frequency bins, and wherein the coherence value is the average coherence over all frequency bins for the given time period.

Example 37 includes the subject matter of any of Examples 27-36, wherein the coherence threshold is user-configurable.

Example 38 includes the subject matter of any of Examples 27-37, wherein increasing the coherence threshold causes a decrease in the detection of speech.

Example 39 includes the subject matter of any of Examples 27-38, wherein decreasing the coherence threshold causes an increase in the detection of speech.

Example 40 is a mobile computing device including the subject matter of any of Examples 27-39.

The foregoing description of example embodiments has been presented for the purposes of illustration and description. This description is not intended to be exhaustive or to limit the present disclosure to the precise forms disclosed. Many modifications and variations are possible in light of this disclosure. This disclosure does not intend to limit the scope of the various embodiments. Future filed applications claiming priority to this application may claim the disclosed subject matter in a different manner, and may generally include any set of one or more limitations as variously disclosed or otherwise demonstrated herein.

What is claimed is:

1. A method for noise estimation and reduction in an audio signal, the method comprising:

determining the power level difference (PLD) between a first microphone input signal and a second microphone input signal for a given time period by subtracting the absolute value of the second microphone input signal from the absolute value of the first microphone input signal, the PLD determination further comprising compensating for at least one of bias or mismatch between the first and second microphones, wherein a coherence value exists between the first and second microphone input signals, and an average coherence value is determined using coherence values for a plurality of frequency bins in the given time period;

determining if speech is detected in the first microphone input signal in the given time period, wherein speech is detected if the PLD between the first and second microphone input signals is a positive value, wherein speech is also detected if the PLD between the first and second microphone input signals is not a positive value but the average coherence value between the first and second microphone input signals is greater than or equal to a predetermined coherence value threshold, and wherein speech is not detected if the PLD between the first and second microphone input signals is not a positive value and the average coherence value between the first and second microphone input signals is less than the predetermined coherence value threshold;

calculating a noise power estimate based on whether speech is detected in the first microphone input signal in the given time period;

calculating a gain using the noise power estimate; and performing noise reduction on the first microphone input signal using the gain to produce a speech signal that has reduced noise or is completely free of noise.

2. The method of claim 1, wherein the average coherence value is determined over all frequency bins in the given time period.

3. The method of claim 1, wherein when speech is detected, calculating the noise power estimate for the given time period includes using a single channel noise estimate technique.

4. The method of claim 3, wherein calculating the noise power estimate for the given time period includes using the noise power estimate for a previous time period.

5. The method of claim 3, further comprising performing at least one other process to further reduce noise in the first microphone input signal.

6. The method of claim 1, wherein when speech is not detected, calculating the noise power estimate for the given time period includes using the coherence value between the first and second microphone input signals.

7. The method of claim 6, wherein calculating the noise power estimate for the given time period includes using the noise power estimate for a previous time period.

8. The method of claim 6, further comprising performing at least one other process to further reduce noise in the first microphone input signal.

9. The method of claim 1, wherein the coherence value between the first and second microphone input signals is determined using cross power spectral densities and auto power spectral densities of the first and second microphone input signals.

10. The method of claim 1, further comprising transforming the first and second microphone input signals into a plurality of time-frequency bins, the plurality of time-frequency bins used to determine the average coherence value over all frequency bins for the given time period.

11. The method of claim 1, wherein the coherence value threshold is user-configurable.

12. The method of claim 1, wherein increasing the coherence value threshold causes a decrease in the detection of speech.

13. The method of claim 1, wherein decreasing the coherence value threshold causes an increase in the detection of speech.

14. A non-transitory computer program product having instructions encoded thereon that when executed by one or more processors cause a process to be carried out, the process comprising:

determine the power level difference (PLD) between a first microphone input signal and a second microphone input signal for a given time period by subtracting the absolute value of the second microphone input signal from the absolute value of the first microphone input signal, the PLD determination further comprising compensating for at least one of bias or mismatch between the first and second microphones, wherein a coherence value exists between the first and second microphone input signals, and an average coherence value is determined using coherence values for a plurality of frequency bins in the given time period;

determine if speech is detected in the first microphone input signal in the given time period, wherein speech is detected if the PLD between the first and second microphone input signals is a positive value, wherein speech is also detected if the PLD between the first and second microphone input signals is not a positive value but the average coherence value between the first and second microphone input signals is greater than or equal to a predetermined coherence value threshold, and wherein speech is not detected if the PLD between the first and second microphone input signals is not a positive value and the average coherence value between the first and second microphone input signals is less than the predetermined coherence value threshold;

calculate a noise power estimate based on whether speech is detected in the first microphone input signal in the given time period;

calculate a gain using the noise power estimate; and perform noise reduction on the first microphone input signal using the gain to produce a speech signal that has reduced noise or is completely free of noise.

15. The computer program product of claim 14, wherein when speech is detected, calculate the noise power estimate for the given time period includes using a single channel noise estimate technique.

16. The computer program product of claim 15, the process further comprising: perform at least one other process to further reduce noise in the first microphone input signal.

17. The computer program product of claim 14, wherein when speech is not detected, calculate the noise power estimate for the given time period includes using the coherence value between the first and second microphone input signals.

18. The computer program product of claim 17, the process further comprising: perform at least one other process to further reduce noise in the first microphone input signal.

19. The computer program product of claim 14, the process further comprising: transform the first and second microphone input signals into a plurality of time-frequency bins, the plurality of time-frequency bins used to determine the average coherence value over all frequency bins for the given time period.

20. A system for noise estimation and reduction, the system comprising:

a first microphone configured to receive a first microphone input signal;

a second microphone configured to receive a second microphone input signal; and at least one processor configured to:

determine the power level difference (PLD) between a first microphone input signal and a second microphone input signal for a given time period by subtracting the absolute value of the second microphone input signal from the absolute value of the first microphone input signal, the PLD determination further comprising compensating for at least one of bias or mismatch between the first and second microphones, wherein a coherence value exists between the first and second microphone input signals, and an average coherence value is determined using coherence values for a plurality of frequency bins in the given time period;

determine if speech is detected in the first microphone input signal in the given time period, wherein speech is detected if the PLD between the first and second microphone input signals is a positive value, wherein speech is also detected if the PLD between the first and second microphone input signals is not a positive value but the average coherence value between the first and second microphone input signals is greater than or equal to a predetermined coherence value threshold, and wherein speech is not detected if the PLD between the first and second microphone input signals is not a positive value and the average coherence value between the first and second microphone input signals is less than the predetermined coherence value threshold;

calculate a noise power estimate based on whether speech is detected in the first microphone input signal in the given time period;

calculate a gain using the noise power estimate; and perform noise reduction on the first microphone input signal using the gain to produce a speech signal that has reduced noise or is completely free of noise.

21. The system of claim 20, wherein when speech is detected, calculate the noise power estimate for the given time period includes using a single channel noise estimate technique.

22. The system of claim 21, the processor further configured to: perform at least one other process to further reduce noise in the first microphone input signal.

23. The system of claim 20, wherein when speech is not detected, calculate the noise power estimate for the given time period includes using the coherence value between the first and second microphone input signals.

24. The system of claim 23, the processor further configured to: perform at least one other process to further reduce noise in the first microphone input signal.

25. A mobile computing device comprising the system of claim 20.

* * * * *